US006621203B2

(12) United States Patent
Nelle et al.

(10) Patent No.: US 6,621,203 B2
(45) Date of Patent: Sep. 16, 2003

(54) DEFLECTION UNIT FOR IN-LINE TYPE CATHODE RAY TUBES HAVING GROOVES SEPARATED BY GROOVE WALLS INCLUDING A THICKENED GROOVE WALL SECTION

(75) Inventors: Friedrich-Karl Nelle, Stuttgart (DE); Andreas Ehrhardt, Plochingen (DE)

(73) Assignee: Matsushita Display Devices (Germany) GmbH, Esslingen (DE)

( * ) Notice: Subject to any disclaimer, the term of this patent is extended or adjusted under 35 U.S.C. 154(b) by 218 days.

(21) Appl. No.: 09/821,809

(22) Filed: Mar. 29, 2001

(65) Prior Publication Data

US 2002/0014825 A1 Feb. 7, 2002

(30) Foreign Application Priority Data

Mar. 29, 2000 (EP) ..... 00106712

(51) Int. Cl.[7] ..... H01J 29/70; H01J 31/00; H01F 1/00; H01F 7/00; H01F 3/12

(52) U.S. Cl. ..... 313/440; 313/477 R; 335/209; 335/210; 335/211; 335/213

(58) Field of Search ..... 313/440, 477 R; 335/209, 210, 211, 213

(56) References Cited

U.S. PATENT DOCUMENTS 4,841,267 A * 6/1989 Watabe et al. ..... 335/210
5,786,661 A * 7/1998 Kim ..... 313/440
5,945,779 A * 8/1999 Inoue et al. ..... 313/440
6,465,943 B2 * 10/2002 Nozawa et al. ..... 313/440

FOREIGN PATENT DOCUMENTS

| | | |
|---|---|---|
| EP | 0 470 315 | 2/1992 |
| EP | 0 590 547 | 4/1994 |
| EP | 0 952 604 | 10/1999 |
| GB | 1537372 | 12/1978 |

* cited by examiner

*Primary Examiner*—Nimeshkumar D. Patel
*Assistant Examiner*—Matt Hodges
(74) *Attorney, Agent, or Firm*—Boyle Fredrickson Newholm Stein & Gratz S.C.

(57) ABSTRACT

The present invention relates to a deflection unit for mounting on an in-line type cathode ray tube comprising a coil body including grooves for receiving wound coil wires, the grooves extending substantially in a straight line. The groove extension of at least one groove is changed at at least one location such that the coil wires received in the groove become curved in the area of the changed groove extension. In a preferred embodiment the grooves are separated from each other by groove walls which in the area of the changed groove extension comprise a thickening and optionally a bulge. The coil wires wound onto the coil body form the horizontal coil or the vertical coil. The arrangement serves the selective fine adjustment of the deflection fields for eliminating convergence, coma and/or geometry errors.

22 Claims, 5 Drawing Sheets

DEFLECTION UNIT FOR IN-LINE TYPE CATHODE RAY TUBES HAVING GROOVES SEPARATED BY GROOVE WALLS INCLUDING A THICKENED GROOVE WALL SECTION

BACKGROUND OF THE INVENTION

1. Field of the Invention

The present invention relates in general to deflection units for in-line type cathode ray tubes and refers, in particular, to those deflection units that comprise a coil body including substantially straight grooves for receiving wound coil wires.

2. Description of the Related Art

In color picture tubes of the in-line type, an electron beam generating system is designed for generating three coplanar electron beams that converge on the screen. The deflection unit which is arranged around the neck portion of the picture tube is used for deflecting the electron beams from their normally straight path into the one or other direction so that the beams impinge upon selected points of the screen to produce a visual signal. With a suitable time variation of the magnetic deflection fields the electron beams can be deflected upwards or downwards and to the right or left side across the screen.

In in-line type color picture tubes three electron guns are positioned side by side. To deflect the generated electron beams into the X- and Y-direction, the funnel-shaped deflection unit mounted on the color picture tube produces deflection fields so that a self-converging picture without north-south raster distortion is obtained on the screen. This funnel-shaped deflection unit consists essentially of a pair of horizontal coils that produce a magnetic field which deflects the beams into the X-direction, a pair of vertical coils for deflection into the Y-direction, a ferrite core which encloses the coils, and correction magnets and possibly soft-magnetic field shapers.

The coil bodies for the pairs of horizontal and vertical coils are normally built up by way of groove winding techniques. A section through such a coil body is shown in FIG. 1*a*. As becomes apparent from the figure, the coil body comprises a plurality of straight grooves 10, 20, 30 into which a winding wire 40 is inserted during winding of coil. Since the groove extends in straight fashion, the winding wire is also wound along a straight line. The field distribution can be varied by changing the distance or an optionally existing angle between neighboring grooves. FIG. 1*b* shows one of the used grooves in cross section.

FIGS. 2*a* and 2*b* show the field distributions of the horizontal and vertical deflection field along the Z-direction, i.e., in the direction towards the screen. As can be gathered from the figures, the field distribution within the deflection unit is variable. In particular, the field distributions in the front and rear portion of the deflection unit differ from one another. The term "front portion" means the portion of the deflection unit that is facing the screen.

In in-line type cathode ray tubes the two following types of errors can among others be observed: convergence errors and geometry errors.

Convergence errors arise when the different primary color images have no congruent rasters. A special type of convergence errors arises in in-line type cathode ray tubes as coma errors because the raster dimensions of the three electron beams on the screen are different. This is a result of the eccentric position of the outer electron beams relative to the horizontal and vertical deflection fields.

Geometry errors cause a deviation of the raster geometry on the screen from that of an ideal raster independently of possible convergence errors. The cause for geometry errors are the different path lengths of the electrons relative to the individual pixels on the screen.

Therefore, correction mechanisms are known in the prior art that aim at a correction of convergence and geometry errors. This is in particular achieved in that inhomogeneous deflection fields as are illustrated in FIGS. 3*a* to 3*d* are produced by complicated winding techniques at specific Z-positions of the deflection unit. These figures show a horizontal barrel field in FIG. 3*a*, a horizontal pincushion field in FIG. 3*b*, a vertical barrel field in FIG. 3*c* and a vertical pincushion field in FIG. 3*d*.

However, the use of such pincushion-shaped or barrel-shaped magnetic deflection fields only permits a convergence error or geometry error correction up to a certain degree of accuracy.

OBJECTS AND SUMMARY OF THE INVENTION

It is therefore the object of the present invention to provide a possibility which allows the production of deflection units for mounting on an in-line type cathode ray tube with less convergence and geometry errors.

According to the invention this object is achieved by a deflection unit for mounting on an in-line type cathode ray tube which comprises a coil body with grooves for receiving wound coil wires, the grooves extending in a substantially straight line. The groove wall of at least one groove at at least one location is changed such that the coil wires received in the groove become curved in the area of the changed groove wall.

This selective change in the groove wall permits a finely adjustable and selective error correction which also permits field distributions differing from the field distributions shown in FIGS. 3*a* to 3*d*. Moreover, changes in the groove wall thickness can be made at any desired locations of the coil body so that many types of errors, including convergence errors, coma errors and geometry errors, can also be dealt with in a selective manner.

In a preferred embodiment the grooves are separated from one another by groove walls which in the area of the changed groove wall comprise a thickening and possibly a bulge on the opposite groove wall. The winding wires are thereby forced into their defined changed position.

Preferred embodiments of the invention are indicated in the subclaims.

BRIEF DESCRIPTION OF THE DRAWINGS

The invention shall now be explained in more detail with reference to the attached drawings, in which.

DETAILED DESCRIPTION OF THE PREFERRED EMBODIMENT

With reference to the attached drawings an embodiment of the invention will now be explained in more detail.

Figure 1A:
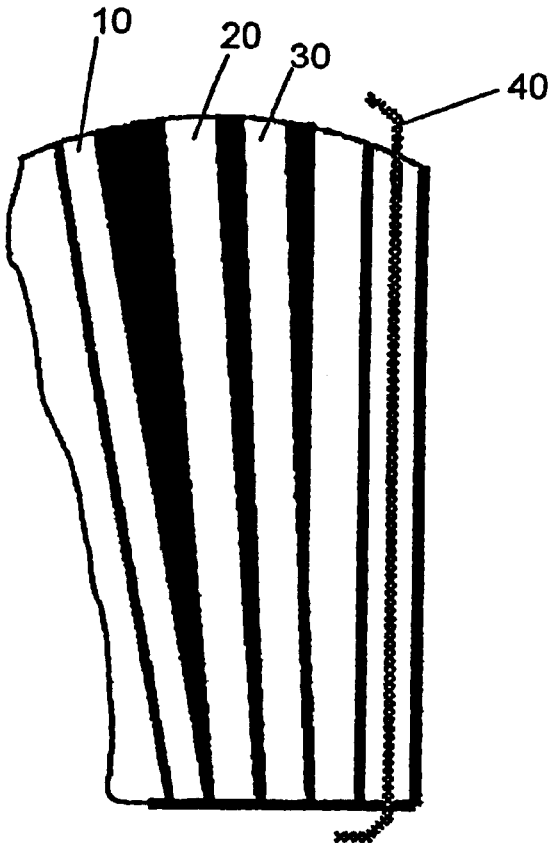
Fig. 1a PRIOR ART
FIG. 1*a* shows a section of a prior-art coil body with a coil wire wound in an exemplary manner.
Figure 1B:
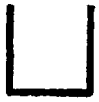
Fig. 1b PRIOR ART
FIG. 1*b* shows a groove cross-section of the arrangement of FIG. 1*a;*
Figure 2A:
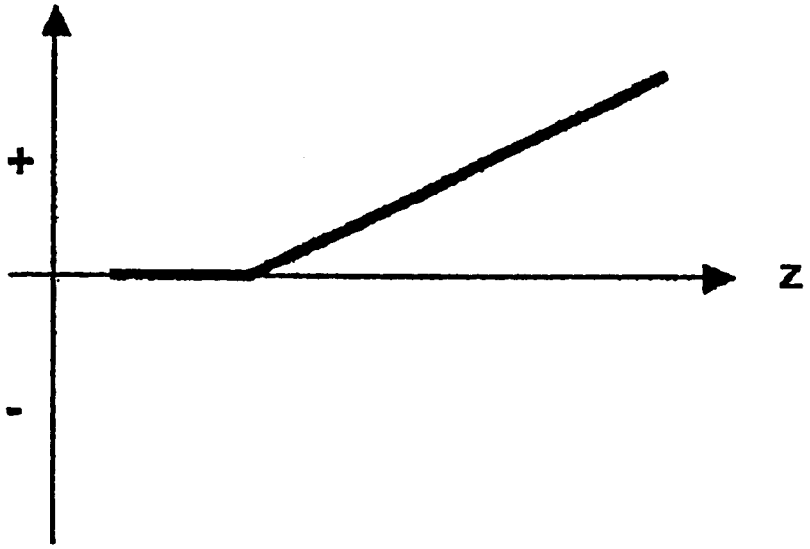
FIG. 2*a* shows the field extension of the horizontal deflection field in Z-direction.
Figure 2B:
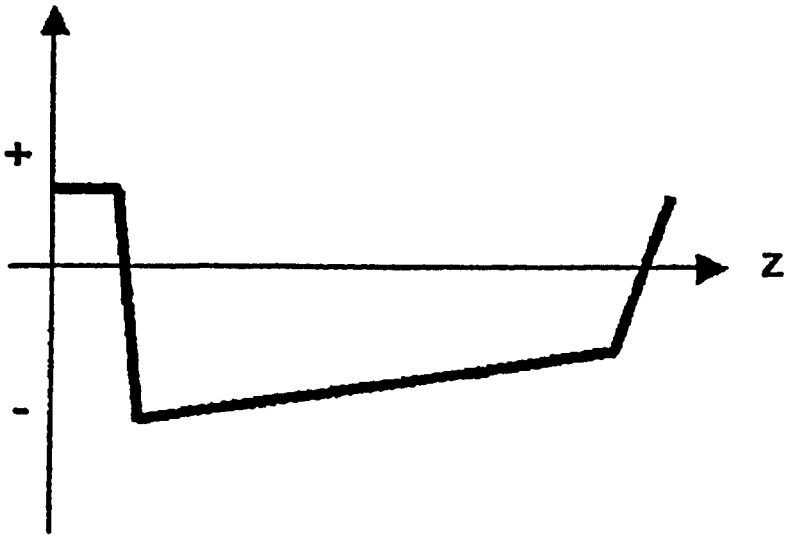
Figure 3A:
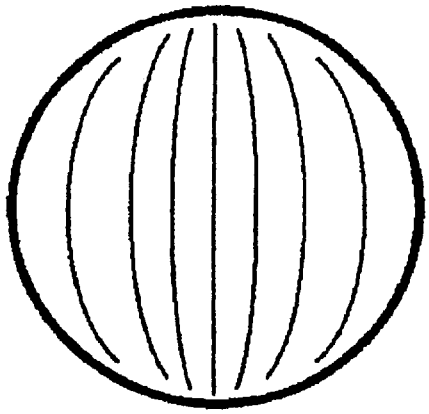
FIG. 3*b* shows a horizontal pincushion-shaped deflection field.
FIG. 3*c* shows a vertical barrel-shaped deflection field.
FIG. 3*d* shows a vertical pincushion-shaped deflection field
Figure 3B:
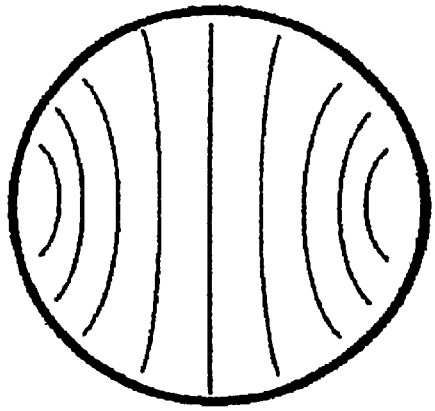
Figure 3C:
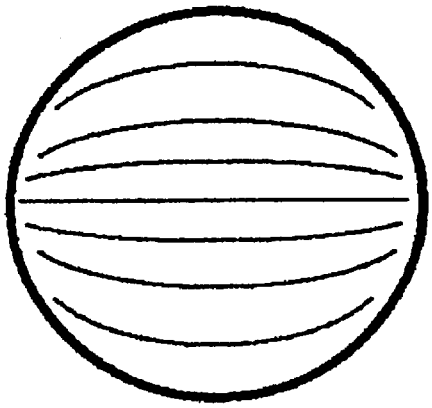
Figure 3D:
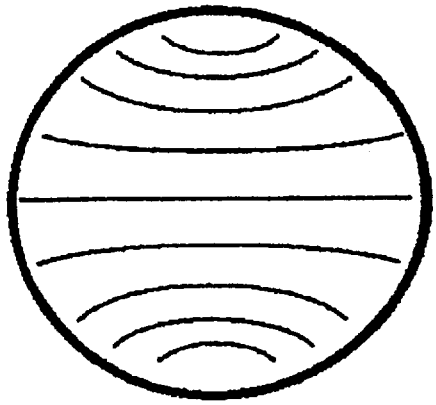
Figure 4A:
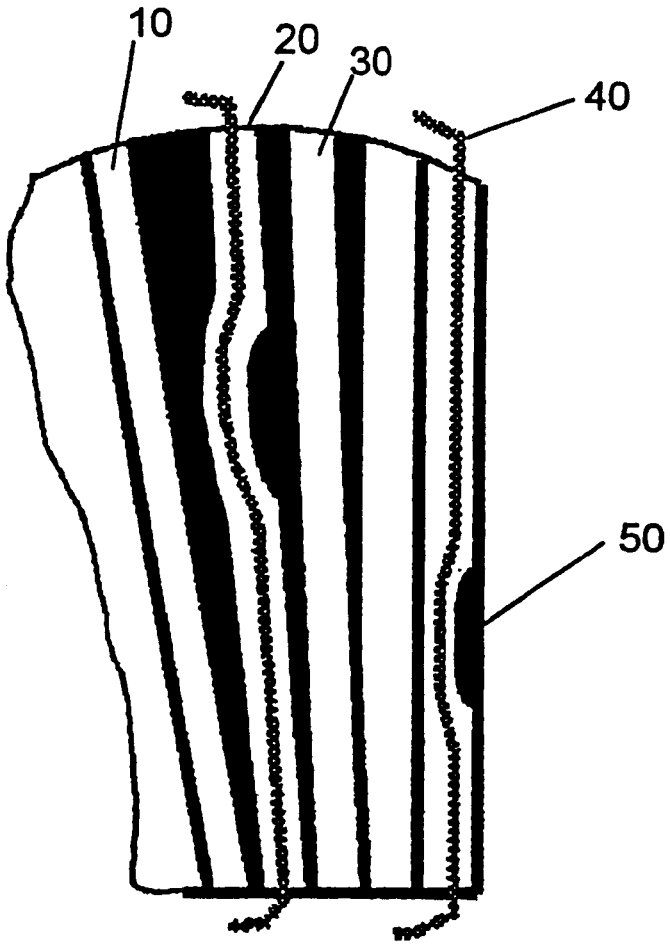
FIG. 4*a* shows a section of a coil body of a deflection unit according to the invention with two coil wires wound in an exemplary manner.
Figure 4B:
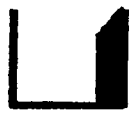
FIG. 4*b* shows a groove wall of FIG. 4*a* changed according to the invention.

FIG. 4*a* shows a section of a coil body according to an embodiment of the present invention. As can be seen from the figure, the coil body similar to that of the prior art shown in FIG. 1*a* comprises straight grooves 10, 30 into which the winding wires 40 are inserted. However, the coil body according to the invention is provided at selected locations 50 with thickened and thinned groove wall sections which force the inserted winding wires into a shape differing from the straight extension. FIG. 4*b* shows the changed cross-section resulting from the unilateral thickening 50 of a section of the groove wall.

The winding wires are forced by the selective thickening and optionally by a bulge opposite to the thickening, as shown in groove 20 in FIG. 4*a*, into such a shape that an error correction becomes possible in a selective manner. In particular, local magnetic field inhomogeneities can be produced that differ from the distributions of the barrel fields or pincushion fields.

In a preferred embodiment of the invention the length of the thickening or bulge along the wound coil wire is approximately within the range of a few millimeters to a few centimeters.

Three special applications of the invention among many possible ones shall now be explained in more detail with reference to FIGS. 5 to 7.

Figure 5:
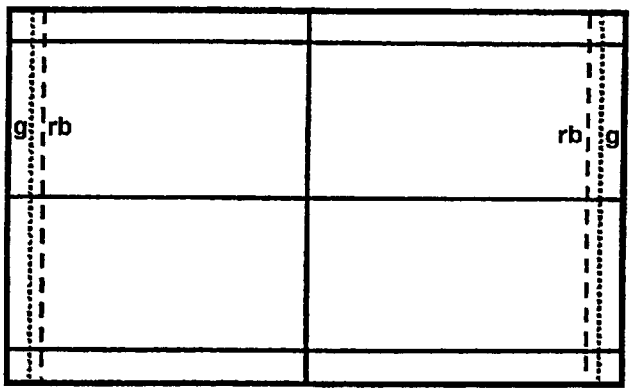
FIG. 5 illustrates a horizontal coma error (g relative to rb)

FIG. 5 illustrates a horizontal coma error which can substantially be corrected by the measure that in the rear portion of the deflection unit the horizontal field is configured in the form of a pincushion. A selective error correction can be achieved according to the invention by the measure that the groove walls are changed at selected places to change the angular position of the winding wires at said places in a selective and suited manner.

Figure 6:
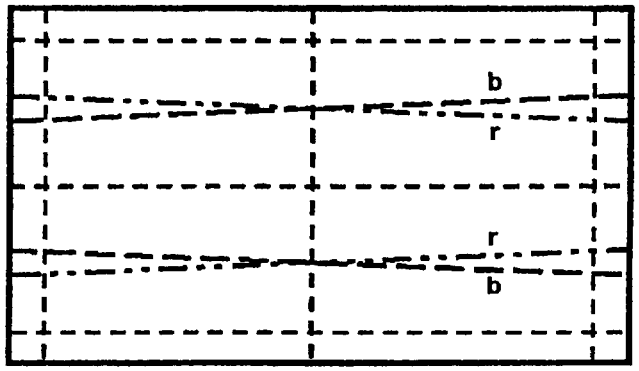
FIG. 6 illustrates a Y-error of rb in the interpixels.

FIG. 6 shows a Y-error of the red and blue images which can substantially be corrected by a barrel field in the central portion of the deflection system. A selective fine correction is now again achieved according to the invention by changing the groove walls, the changes being made in the central portion of the deflection unit.

Figure 7:
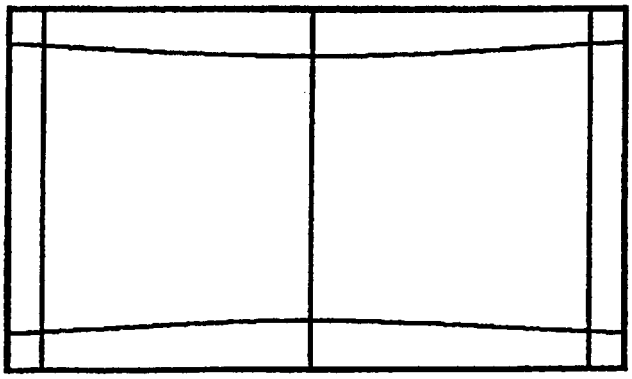
FIG. 7 shows a north-south pincushion distortion.

Finally, FIG. 7 shows a north-south pincushion distortion which inter alia becomes the smaller the more pincushion-shaped the field is in the front portion of the deflection unit. A selective error correction can now be accomplished by changing groove walls in the front portion of the deflection system.

What is claimed is:

1. A deflection unit for mounting on an in-line type cathode ray tube, comprising a coil body with grooves for receiving wound coil wires, the grooves extending in a substantially straight line, wherein the grooves are separated by groove walls at least one of which has a thickened section such that the coil wire received in the one groove becomes curved in the area of the thickened section.

2. The deflection unit according to claim 1, wherein the deflection unit further comprising a bulge in another groove wall.

3. The deflection unit according to claim 1, wherein the coil wires wound onto the coil body form a horizontal coil.

4. The deflection unit according to claim 1, wherein the coil wires wound onto the coil body form a vertical coil.

5. The deflection unit according to claim 1, wherein the thickened groove wall section is dimensioned and configured to correct convergence errors.

6. The deflection unit according to claim 1, wherein the thickened groove wall section is dimensioned and configured to correct coma errors.

7. The deflection unit according to claim 1, wherein the thickened groove wall section is dimensioned and configured to correct geometry errors.

8. The deflection unit according to claim 1, wherein the coil body is made from plastics.

9. An in-line type cathode ray tube comprising a deflection unit according to claim 1.

10. A display apparatus comprising an in-line type cathode ray tube and a deflection unit according to claim 1.

11. The deflection unit according to claim 2, wherein the bulge is disposed on section of a groove wall opposite the thickened section of the one groove wall.

12. A deflection unit for mounting on an in-line type cathode ray tube, comprising:

a coil body with grooves for receiving wound coil wires, wherein the grooves extend in a substantially straight line, and wherein the grooves are separated by groove walls at least one of which has at least one section which is thickened when compared to an adjacent section such that a coil wire received in a corresponding groove becomes curved in the area of the thickened section of the one groove wall.

13. The deflection unit according to claim 12, wherein another groove wall includes at least one section that is bulged when compared to an adjacent section of the another grove wall.

14. The deflection unit according to claim 12, wherein the another groove wall is disposed on an opposite side of the corresponding groove from the one groove wall, and wherein the bulged section of the another groove wall is at least generally aligned with the thickened section of the one groove wall.

15. The deflection unit according to claim 12, wherein the coil wires are wound onto the coil body so as to form a horizontal coil.

16. The deflection unit according to claim 12, wherein the coil wires are wound onto the coil body so as to form a vertical coil.

17. The deflection unit according to claim 12, wherein the thickened section of the one groove wall is dimensioned and configured to correct convergence errors.

18. The deflection unit according to claim 12, wherein the thickened section of the one groove wall is dimensioned and configured to correct coma errors.

19. The deflection unit according to claim 12, wherein the thickened section of the one groove wall is dimensioned and configured to correct geometry errors.

20. The deflection unit according to claim 12, wherein the coil body is made from plastics.

21. An in-line type cathode ray tube comprising a deflection unit that includes:

a coil body with grooves for receiving wound coil wires, wherein the grooves extend in a substantially straight line, and wherein the grooves are separated by groove walls at least one of which has at least one section which is thickened when compared to an adjacent section such that a coil wire received in a corresponding groove becomes curved in the area of the thickened section of the one groove wall.

22. A display apparatus comprising an in-line type cathode ray tube, and a deflection unit that includes:

a coil body with grooves for receiving wound coil wires, wherein the grooves extend in a substantially straight line, and wherein the grooves are separated by groove walls at least one of which has at least one section which is thickened when compared to an adjacent section such that a coil wire received in a corresponding groove becomes curved in the area of the thickened section of the one groove wall.

* * * * *